US010479955B2

(12) United States Patent
Sawaguchi et al.

(10) Patent No.: US 10,479,955 B2
(45) **Date of Patent: *Nov. 19, 2019**

(54) LUBRICATING GREASE COMPOSITION

(71) Applicant: Nok Klueber Co. Ltd., Tokyo (JP)

(72) Inventors: Wataru Sawaguchi, Kita Ibara (JP); Motoyuki Inai, Kita Ibara (JP); Akira Shinozaki, Kita Ibara (JP)

(73) Assignee: Nok Klueber Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/711,060

(22) Filed: Sep. 21, 2017

(65) Prior Publication Data

US 2018/0016516 A1 Jan. 18, 2018

Related U.S. Application Data

(63) Continuation of application No. PCT/JP2016/054891, filed on Feb. 19, 2016.

(30) Foreign Application Priority Data

Mar. 27, 2015 (JP) ..... 2015-066851

(51) Int. Cl.

| | |
|---|---|
| ***C10M 169/00*** | (2006.01) |
| ***C10M 147/02*** | (2006.01) |
| ***C10M 107/02*** | (2006.01) |
| ***C10M 117/02*** | (2006.01) |
| ***C10M 169/02*** | (2006.01) |
| ***C10M 169/06*** | (2006.01) |
| *C10M 117/00* | (2006.01) |
| *C10N 20/02* | (2006.01) |
| *C10N 40/02* | (2006.01) |

(52) U.S. Cl.

CPC ..... *C10M 169/00* (2013.01); *C10M 107/02* (2013.01); *C10M 117/02* (2013.01); *C10M 147/02* (2013.01); *C10M 169/02* (2013.01); *C10M 169/06* (2013.01); *C10M 117/00* (2013.01); *C10M 2205/0225* (2013.01); *C10M 2205/0285* (2013.01); *C10M 2207/106* (2013.01); *C10M 2207/1256* (2013.01); *C10M 2209/1023* (2013.01); *C10M 2213/062* (2013.01); *C10M 2215/065* (2013.01); *C10M 2219/044* (2013.01); *C10M 2223/045* (2013.01); *C10N 2020/02* (2013.01); *C10N 2040/02* (2013.01); *C10N 2210/01* (2013.01); *C10N 2210/02* (2013.01); *C10N 2230/06* (2013.01); *C10N 2250/10* (2013.01)

(58) Field of Classification Search

None

See application file for complete search history.

(56) References Cited

U.S. PATENT DOCUMENTS

| | | | | |
|---|---|---|---|---|
| 5,110,489 | A * | 5/1992 | Stadler | C10M 143/02 508/236 |
| 2007/0149422 | A1* | 6/2007 | Miyajima | C10M 159/06 508/451 |
| 2009/0270290 | A1 | 10/2009 | Sawaguchi et al. | |
| 2015/0232778 | A1 | 8/2015 | Arai et al. | |

FOREIGN PATENT DOCUMENTS

| | | |
|---|---|---|
| CN | 102134523 | 7/2014 |
| CN | 104449983 | 3/2015 |
| JP | H03-128994 A | 5/1991 |
| JP | 2005-213329 A | 8/2005 |
| JP | 2006-182923 A | 7/2006 |
| JP | 2008-101122 A | 5/2008 |
| JP | 2008-274141 A | 11/2008 |
| JP | 2010-248442 A | 11/2010 |
| JP | 2011-148908 A | 8/2011 |
| JP | 2012-102191 A | 5/2012 |
| JP | 2014-047276 A | 3/2014 |
| WO | WO 2004-081156 A1 | 9/2004 |

OTHER PUBLICATIONS

Japan Patent Office, International Search Report and Written Opinion, PCT/JP2016/054891, 10 pages, dated Mar. 15, 2016.

Japan Patent Office, International Search Report, PCT/JP2016/054891, 3 pages, dated Mar. 15, 2016 (Translation of the International Search Report of Reference AM).

Japan Patent Office, Decision to Grant a Patent; in a corresponding Japanese Application No. 2016-526369, 3 pages, dated Jun. 13, 2016.

Japan Patent Office, Decision to Grant a Patent; in a corresponding Japanese Application No. 2016-526369, 3 pages, dated Jun. 13, 2016 (English Translation of Ref. AN).

International Searching Authority, Written Opinion of the International Search Authority (Translation), PCT/JP2016/054891, 4 pages, dated Mar. 15, 2016.

International Searching Authority, International Preliminary Report on Patentability Chapter I (Translation), PCT/JP2016/054891, 5 pages, dated Oct. 3, 2017.

State Intellectual Property Office of People's Republic of China, Office Action, Application No. 201680018729.9, 6 pages, dated Mar. 5, 2018.

(Continued)

*Primary Examiner* — Vishal V Vasisth

(74) *Attorney, Agent, or Firm* — Sunstein Kann Murphy & Timbers LLP

(57) ABSTRACT

A lubricating grease composition for a resin member is used to be supplied as a lubricant on a surface of at least a sliding portion of a resin member including the sliding portion with an other member. The lubricating grease composition for a resin member contains a base oil which is a mixed oil of a poly-α-olefin having a kinetic viscosity at 40° C. of 18 to 50 $mm^2/s$ and an ethylene-α-olefin copolymer having a number average molecular weight of 40,000 to 200,000, a lithium-based complex soap as a thickener and a polytetrafluoroethylene resin as a solid lubricant having a mixing ratio of 4 to 12 mass % to the entire lubricating grease composition, wherein the base oil has a kinetic viscosity at 40° C. of 80 to 200 $mm^2/s$ and a worked penetration of the lubricating grease composition ranges from 265 to 340.

4 Claims, No Drawings

(56) References Cited

OTHER PUBLICATIONS

State Intellectual Property Office of People's Republic of China (English Translation), Office Action, Application No. 201680018729.9, 7 pages, dated Mar. 5, 2018.
Chinese Patent Office, Notification for Granting an Invention Patent, Application No. 201680018729.9, dated Jul. 17, 2018, 1 page.
Chinese Patent Office (*English Translation*), Notification for Granting an Invention Patent, Application No. 201680018729.9, dated Jul. 17, 2018, 1 page.
Canadian Intellectual Property Office, Examination Report dated Oct. 9, 2018 in corresponding Canadian Application No. 2,980,987, PCT No. JP201605481; 5 pages.
Canadian Intellectual Property Office, Examination Report, Application No. 2,980,987, dated Feb. 28, 2019, 3 pages.

* cited by examiner

LUBRICATING GREASE COMPOSITION

CROSS REFERENCE TO RELATED APPLICATIONS

The present application is a continuation application of International Patent Application No. PCT/JP2016/054891 filed on Feb. 19, 2016, which claims priority to Japanese Patent Application No. 2015-066851, filed on Mar. 27, 2015. The contents of these applications are incorporated herein by reference in their entirety.

BACKGROUND

Technical Field

The present disclosure relates to a lubricating grease composition for a resin member used to be supplied as a lubricant on the surface of at least a sliding portion of a resin member including the sliding portion where, for example, the other member comprising a resin member or a metal material slides or which slides on the other member, and particularly relates to a lubricating grease composition for a resin member that enables the decrease of a starting friction coefficient and also the improvement of wear resistance at a contact portion surface of a resin member particularly under a high load state.

Background Art

Heretofore, greases have been used as lubricant compositions used for the sliding portion, and the like, of gears and various machine parts. In recent years, resin members have been increasingly used for the sliding portions, and the like, of gears and various machine parts of automobile parts, home electronics, electronic information instruments, office automation appliances, and the like, for the purpose of weight saving and cost saving.

For example, Japanese Patent Application Publication No. 2010-248442 describes a grease composition containing a thickener and a base oil, wherein the base oil contains an ethylene-propylene copolymer and a synthetic hydrocarbon oil having a kinetic viscosity at 40° C. of 50 $mm^2/s$ or less and using a high viscosity base oil having a base oil kinetic viscosity at 40° C. of 500 to 1500 $mm^2/s$, thereby also improving low-temperature performance in addition to improving lubricity and preventing wear of machine parts.

Further, the present applicant proposed, in Japanese Patent Application Publication No. 2011-148908, a grease composition that contains a base oil containing a poly-α-olefin and an ethylene-α-olefin copolymer and a thickener, wherein a kinetic viscosity at 40° C. of the poly-α-olefin ranges from 18 to 400 $mm^2/s$, a number average molecular weight of the ethylene-α-olefin copolymer ranges from 40000 to 200000 and a mixing amount thereof ranges from 4 to 12 mass % to the entire grease composition, a kinetic viscosity at 40° C. of the base oil ranges from 400 to 2500 $mm^2/s$, and the thickener is an alkali metal-based soap and/or an alkali metal-based complex soap, or the like, of 2 to 8 mass % in total to the entire grease composition and can impart a lubricating effect to the resin surface, thereby achieving both low-temperature performance and torque stability under endurance conditions.

Furthermore, the present applicant proposed, in Japanese Patent Application Publication No. 2008-101122, a grease composition that contains a base oil which is at least one of a synthetic hydrocarbon oil, an ester-based synthetic oil and an ether-based synthetic oil, a thickener which is at least one of a lithium-based soap, a lithium-based complex soap and a urea-based compound, a polytetrafluoroethylene resin powder having a number average molecular weight Mn of 20,000 to 100,000, and a zinc dialkyldithiophosphate having a linear or branched alkyl group of 3 or more carbon atoms, thereby achieving good lubricity to a member made of a resin and durability demonstrated by the changes in the friction coefficient and the wear loss after a sliding test.

However, the grease composition described in Japanese Patent Application Publication No. 2010-248442 has a base oil kinetic viscosity at 40° C. of 500 to 1500 $mm^2/s$ and further the grease composition described in Japanese Patent Application Publication No. 2011-148908 has a base oil kinetic viscosity at 40° C. ranging from 400 to 2500 $mm^2/s$, both of which use the high viscosity base oils and thus render good lubricity and durability at the sliding portions to which the grease compositions are applied, but a starting friction coefficient (static friction coefficient) at the time of use under a high load condition as in particularly automobile parts, and the like, increases, thereby accordingly increasing an energy loss, hence problematic.

Further, even when the grease composition for the use at the sliding portion of machine parts, which is identical to those suitable for metal members, is used for resin members, the sliding properties and wear resistance similar to metal members are not always achieved. As Japanese Patent Application Publication No. 2010-248442 does not describe the materials of machine parts to which the grease composition is used, it presumably does not assume the development of a grease composition suitable by the material of machine parts, particularly a grease composition suitable for resin members.

Furthermore, a kinetic viscosity at 40° C. of the base oil of the grease composition in Japanese Patent Application Publication No. 2008-101122 is not described, and the grease composition is thus not developed with the intention of decreasing the starting friction coefficient at the time of use under a high load state.

The present disclosure is related to providing a lubricating grease composition with a decreased starting friction coefficient and improved wear resistance at a contact portion surface of a resin member particularly under a high load state by suitably adjusting a base oil, a thickener and a solid lubricant.

SUMMARY

Aspects of the present disclosure are as follows.

(1) A lubricating grease composition for a resin member used to be supplied as a lubricant on a surface of at least a sliding portion of a resin member including the sliding portion with an other member, wherein the lubricating grease composition for a resin member contains a base oil which is a mixed oil of a poly-α-olefin having a kinetic viscosity at 40° C. of 18 to 50 $mm^2/s$ and an ethylene-α-olefin copolymer having a number average molecular weight of 40,000 to 200,000, a lithium-based complex soap as a thickener, and a polytetrafluoroethylene resin as a solid lubricant having a mixing ratio of 4 to 12 mass % to the entire lubricating grease composition, wherein the base oil has a kinetic viscosity at 40° C. of 80 to 200 $mm^2/s$, and a worked penetration of the lubricating grease composition ranges from 265 to 340.

(2) The lubricating grease composition for a resin member according to the above (1), wherein the ethylene-α-olefin copolymer has a mixing ratio ranging from 1.5 to 3.5 mass % to the entire lubricating grease composition.

(3) The lubricating grease composition for a resin member according to the above (1) or (2), wherein a material of the resin member is a polyamide resin.

(4) The lubricating grease composition for a resin member according to the above (1), (2) or (3), wherein the other member is a metal member.

The present disclosure thus enables the provision of a lubricating grease composition with a decreased starting friction coefficient and improved wear resistance at a contact portion surface of a resin member particularly under a high load state by containing a base oil which is a mixed oil of a poly-α-olefin having a kinetic viscosity at 40° C. of 18 to 50 $mm^2/s$ and an ethylene-α-olefin copolymer having a number average molecular weight of 40,000 to 200,000, a lithium-based complex soap as a thickener, a polytetrafluoroethylene resin as a solid lubricant having a mixing ratio of 4 to 12 mass % to the entire grease composition, wherein the base oil is adjusted to have a kinetic viscosity at 40° C. of 80 to 200 $mm^2/s$ and a worked penetration of the grease composition is adjusted to in the range from 265 to 340.

DETAILED DESCRIPTION

Next, embodiments of the present disclosure are described below.

The lubricating grease composition for a resin member according to the present disclosure is used to be supplied as a lubricant on the surface of at least a sliding portion of a resin member including the sliding portion with other members and has properties to realize a low starting friction coefficient and good wear resistance at a contact portion surface of the resin member particularly under a high load state.

Additionally, the resin member to which the lubricating grease composition of the present disclosure is used as a lubricant is not particularly limited but a resin member comprising, for example, a polyamide (PA) resin is preferable in light of remarkably rendering the above effects. Note that, in the present disclosure, the surface of a resin member to which the lubricating grease composition is supplied is expressed as "the surface of at least a sliding portion" for the reason of not only including the case in which the lubricating grease composition is supplied only to the sliding portion but also the case in which the composition is supplied to other surface portions of the resin member in addition to the sliding portion and to throughout the entire resin members.

Examples of the material for other members include resin materials and metal materials. The resin material may be resin materials having the identical composition to or a different composition from the resin member. Note that the lubricating grease composition of the present disclosure, when the other members are metal members, is preferable in terms of rendering particularly remarkable effects for the use as a lubricant on the surface of the resin member.

The "a high load state" herein refers to a state in which a high load is applied and specifically means the state in which a contact average surface pressure of 30 MPa or more is applied at a temperature ranging from −40° C. to +150° C. Additionally, the "starting friction coefficient" means a starting friction coefficient (static friction coefficient) at the time of low-speed sliding.

The lubricating grease composition of the present disclosure contains a base oil, a thickener and a solid lubricant.

(Base Oil)

In the present disclosure, the base oil is a mixed oil of a poly-α-olefin having a kinetic viscosity at 40° C. of 18 to 50 $mm^2/s$ and an ethylene-α-olefin copolymer having a number average molecular weight of 40,000 to 200,000, and the kinetic viscosity at 40° C. of the base oil is 80 to 200 $mm^2/s$. Both poly-α-olefin and ethylene-α-olefin copolymer are synthetic hydrocarbon oils, and the base oil, when, for example, an ester-based synthetic oil or an ether-based synthetic oil is used other than the synthetic hydrocarbon oil, may adversely affect the resin members, and it is thus preferable that the base oil is the mixed oil of a poly-α-olefin and an ethylene-α-olefin copolymer without containing an ester-based synthetic oil and an ether-based synthetic oil but constituted only by the synthetic hydrocarbon oil.

In the present disclosure, the poly-α-olefin refers to a polymer obtained by homopolymerizing or copolymerizing monomers comprising one or two or more of α-olefins having three or more carbon atoms.

The α-olefin herein is not particularly limited but examples thereof include linear terminal olefins having preferably 3 to 30 carbon atoms, more preferably 4 to 20 carbon atoms, further preferably 6 to 16 carbon atoms. More specifically, propylene, 1-butene, 1-pentene, 1-hexene, and the like, are included.

In the present disclosure, for the characteristics of the poly-α-olefin, a kinetic viscosity at 40° C. ranges from 18 to 50 $mm^2/s$. This is because when a kinetic viscosity at 40° C. of the poly-α-olefin is lower than 18 $mm^2/s$, the wear resistance deteriorates, whereas such a viscosity is higher than 50 $mm^2/s$, the starting friction coefficient at a high load state increases.

It is preferable that the poly-α-olefin have a mixing ratio ranging from 75 to 85 mass % to the entire lubricating grease composition.

Note that the degree of polymerization of poly-α-olefin is not particularly limited and includes those usually termed the oligomers. Additionally, one of the poly-α-olefins may be used singly or two or more thereof may be used in mixture.

In the present disclosure, the ethylene-α-olefin copolymer refers to a copolymer comprising, as the constituent monomers, ethylene and one or two or more of α-olefins having three or more carbon atoms.

The α-olefin in the ethylene-α-olefin copolymer herein is not particularly limited but examples thereof include linear terminal olefins having preferably 3 to 30 carbon atoms, more preferably 4 to 20 carbon atoms, further preferably 6 to 16 carbon atoms. More specifically, propylene, 1-butene, 1-pentene, 1-hexene, and the like, are included. Note that one of the poly-α-olefins may be used singly or two or more thereof may be used. Note that the ethylene-α-olefin copolymer may have any of the structures of random copolymer, alternating copolymer, periodic copolymer or block copolymer.

The number average molecular weight of the ethylene-α-olefin copolymer ranges from 40,000 to 200,000. This is because when a number average molecular weight of the ethylene-α-olefin copolymer is less than 40,000, the starting friction coefficient at a high load state increases, whereas when a number average molecular weight is more than 200,000, the shear stability deteriorates.

It is preferable that the ethylene-α-olefin copolymer have a mixing ratio ranging from 1.5 to 3.5 mass % to the entire lubricating grease composition. When a mixing amount of the ethylene-α-olefin copolymer is less than 1.5 mass %, the base oil viscosity may not be increased to the suitable range, whereas such the viscosity is more than 3.5 mass %, the base oil viscosity may be much higher than the suitable range.

In the present disclosure, the base oil being the mixed oil of the above poly-α-olefin and the ethylene-α-olefin copolymer must have a kinetic viscosity at 40° C. of 80 to 200 $mm^2/s$. This is because when a kinetic viscosity at 40° C. is lower than 80 $mm^2/s$, the wear resistance deteriorates, whereas a kinetic viscosity at 40° C. is higher than 200 $mm^2/s$, the starting friction coefficient at a high load state increases.

(Thickener)

For the thickener in the lubricating grease composition of the present disclosure, a lithium-based complex soap having good lubricity to and compatibility with the resin member is used.

Specific examples of the lithium-based complex soap include those obtained by reacting fatty acids such as stearic acid, oleic acid, and palmitic acid, and/or hydroxy fatty acids having 12 to 24 carbon atoms having one or more hydroxyl groups in a molecule and at least one selected from the group consisting of aromatic carboxylic acids, aliphatic dicarboxylic acids having 2 to 20 carbon atoms (more preferably 4 to 12 carbon atoms) and carboxylic acid monoamides to, for example, a lithium compound such as lithium hydroxide.

The above hydroxy fatty acid having 12 to 24 carbon atoms is not particularly limited and examples thereof include 12-hydroxystearic acid, 12-hydroxylauric acid, 16-hydroxypalmitic acid, with 12-hydroxystearic acid being particularly preferable among these.

Examples of the aromatic carboxylic acid include benzoic acids, phthalic acids, isophthalic acids, terephthalic acids, trimellitic acids, pyromellitic acids, salicylic acids, p-hydroxybenzoic acids, and the like.

Further, the above aliphatic dicarboxylic acid having 2 to 20 carbon atoms is not particularly limited and examples thereof include oxalic acids, malonic acids, succinic acids, methylsuccinic acids, glutaric acids, adipic acids, pimelic acids, suberic acids, azelaic acids, sebacic acids, nonamethylenedicarboxylic acids, decamethylenedicarboxylic acids, undecanedicarboxylic acids, dodecanedicarboxylic acids, tridecanedicarboxylic acids, tetradecanedicarboxylic acids, pentadecanedicarboxylic acids, hexadecanedicarboxylic acids, heptadecanedicarboxylic acids, octadecanedicarboxylic acids, and the like, with adipic acids, pimelic acids, suberic acids, azelaic acids, sebacic acids, nonamethylenedicarboxylic acids, decamethylenedicarboxylic acids, undecanedicarboxylic acids, dodecanedicarboxylic acids, tridecanedicarboxylic acids, tetradecanedicarboxylic acids, pentadecanedicarboxylic acids, hexadecanedicarboxylic acids, heptadecanedicarboxylic acids, octadecanedicarboxylic acids, and the like, being preferably used. Of these, azelaic acids and sebacic acids are preferable.

Further, examples of the carboxylic acid monoamide include those in which one of the carboxyl groups of the above dicarboxylic acid is amidated. Preferable examples include those in which one of the carboxyl groups of azelaic acid or sebacic acid is amidated.

Examples of the amine to be amidated include aliphatic primary amines such as butylamine, amylamine, hexylamine, heptylamine, octylamine, nonylamine, decylamine, laurylamine, myristyl amine, palmityl amine, stearyl amine, and behenyl amine, aliphatic secondary amines such as dipropylamine, diisopropylamine, dibutylamine, diamylamine, dilaurylamine, monomethyl laurylamine, distearylamine, monomethyl stearylamine, dimyristylamine, dipalmitylamine, and the like, aliphatic unsaturated amines such as allylamine, diallylamine, oleylamine, and dioleylamine, alicyclic amines such as cyclopropylamine, cyclobutylamine, cyclopentylamine, and cyclohexylamine, aromatic amines such as aniline, methylaniline, ethylaniline, benzylamine, dibenzylamine, diphenylamine, and α-naphthylamine, with hexylamine, heptylamine, octylamine, nonylamine, decylamine, laurylamine, myristyl amine, palmityl amine, stearylamine, behenyl amine, dibutylamine, diamylamine, monomethyl laurylamine, monomethyl stearylamine, oleylamine, and the like, being preferably used.

When the lithium-based complex soap is mixed, carboxylic acids and/or esters thereof and the above metal hydroxide may be fed to the base oil and saponified in the base oil to be mixed.

When the lithium-based complex soap is prepared by carrying out the saponification reaction in the base oil, it is preferable to use, for example, the combination of stearic acid and/or 12-hydroxystearic acid as the carboxylic acid and azelaic acid or sebacic acid and the like.

Note that when the saponification reaction is carried out in the base oil, a plurality of carboxylic acids and/or esters thereof and acid amide may be saponified simultaneously or may be saponified sequentially.

It is preferable that the lithium-based complex soap have a mixing ratio of 8 to 14 mass % to the entire lubricating grease composition. This is because when a mixing amount is less than 8 mass %, the necessary thickening effect may not be attained, whereas such an amount is more than 14 mass %, the composition may become too hard likely, resulting in causing poor influx property to the portions to be lubricated.

(Solid Lubricant)

In the lubricating grease composition of the present disclosure, the solid lubricant is a polytetrafluoroethylene (PTFE) resin in terms of the low starting friction at a high load state.

It is preferable that the PTFE resin have a mixing ratio of 4 to 12 mass % to the entire lubricating grease composition. This is because when a mixing ratio is less than 4 mass %, the starting friction coefficient at a high load state increases, whereas when such a ratio is more than 12 mass %, the supply of grease composition to the sliding portion of the resin member is short and the wear resistance deteriorates.

It is preferable that the PTFE resin is contained in the grease composition in the form of a powder. For the PTFE resin powder, those having a molecular weight of several-hundred thousands at maximum are commonly used for the typical lubrication usage, but for the grease composition of the present disclosure, those having a number average molecular weight Mn (calculated from melting point Tm) of about 20,000 to 100,000, preferably about 20,000 to 80,000, are used. When those having a molecular weight outside the above ranges are used, the decrease in the friction coefficient at the time of sliding is not achieved, thereby accordingly failing to maintain the durability. The adjustment to such a molecular weight can be carried out by a method of adjusting the amount of a chain transfer agent added at the time of the polymerization by the suspension polymerization method, the emulsion polymerization method, the solution polymerization method and the like, or the molecular weight reduction method by irradiation and the like.

Additionally, for the particle size of the PTFE resin powder (a primary particle size directly measured from an electron micrograph, or a mean particle size when the primary particle size is not clearly determinable due to a dense aggregation), those having 0.2 to 10 μm, preferably about 0.3 to 5 μm, are used. When those having a particle size smaller than these ranges are used, a problem appears in the durability, whereas when those having a particle size larger than these ranges are used, the addition effect is not demonstrated due to the supply failure of the particles to the surfaces to be lubricated. For the PTFE resin powder having such a molecular weight and particle size, commercial products can be also used directly.

Additionally, the grease composition of the present disclosure has a worked penetration ranging from 265 to 340 in terms of good lubricity at a high load state. This is because when a worked penetration is less than 265, the starting friction coefficient at a high load state increases, whereas such a worked penetration is more than 340, the oil separation amount of the grease composition supplied to the sliding portion increases and the wear resistance deteriorates.

To the grease composition, other additives such as an antioxidant, a rust preventive, an extreme pressure agent, an oily agent, and a viscosity index improver, which have been added to the greases can be added as necessary in a range within which the effects of the present disclosure are not affected.

Examples of the antioxidant include phenol-based antioxidants such as 2,6-ditertiary butyl-4-methylphenol, and 4,4'-methylenebis(2,6-ditertiary butylphenol), amine-based antioxidants such as alkyl diphenylamine, triphenylamine, phenyl-α-naphthylamine, phenothiazine, alkylated phenyl-α-naphthylamine, and alkylated phenythiazine. Additionally, phosphorus-based antioxidants and sulfur-based antioxidants are also used.

Examples of the rust preventive include Ca salts or Na salts of aromatic sulfonic acids or saturated aliphatic dicarboxylic acids, fatty acids, fatty acid amines, alkylsulfonic acid metal salts, alkylsulfonic acid amine salts, oxidized paraffins, polyoxyalkyl ethers, and the like.

Examples of the extreme pressure agent include phosphorus-based compounds such as phosphate esters, phosphite esters, phosphate and ester amines, sulfur-based compounds such as sulfides and disulfides, sulfur-based compound metal salts such as dialkyldithiophosphoric acid metal salts (excluding zinc salts), and dialkyldithiocarbamic acid metal salts, chlorine-based compounds such as chlorinated paraffins and chlorinated diphenyls, and organometallic compounds such as molybdenum dialkyldithiocarbamates (MoDTP).

Examples of the oily agent include fatty acids or esters thereof, higher alcohols, polyhydric alcohols or esters thereof, aliphatic esters, aliphatic amines, aliphatic monoglycerides, montan waxes, amide-based waxes, and the like.

Examples of the viscosity index improver include polymethacrylates, ethylene-propylene copolymers, polyisobutylenes, polyalkylstyrenes, styrene-isoprene hydrogenated copolymers, and the like.

The composition is prepared by a method wherein each of the above components are added in a predetermined amount and thoroughly kneaded using a triple roll or a high-pressure homogenizer.

EXAMPLES

Hereinafter, the present disclosure is described in further detail in reference with Examples but not limited to these Examples.

Examples 1 to 10 and Comparative Examples 1 to 17

(1) Preparation Method of Lubricating Grease Compositions

The preparation method of lubricating grease compositions was carried out by the following method.

(i) Case in which the Lithium Complex Soap (Li-Comp) was Used as the Thickener

First, the base oil and 12-hydroxystearic acid (thickener component) and lithium hydroxide (thickener component) were mixed in predetermined amounts in a mixing and stirring tank and stirred with heating at about 80 to 130° C. to carry out the saponification reaction. Further, azelaic acid (thickener component) was mixed in a predetermined amount and stirred with heating at about 80 to 200° C., to which lithium hydroxide (thickener component) was further added to carry out the saponification reaction, followed by cooling to produce a gelatinous substance. Each of the additives such as a PTFE powder was added to the produced gelatinous substance, stirred and subsequently passed through a roll mill or a high-pressure homogenizer to prepare lubricating grease compositions containing each of the components shown below in the mixing amounts (mass %) shown in Table 1 and Table 2. Note that the amount of each component constituting the thickener mixed was 63.5 mass % of 12-hydroxystearic acid, 19.0 mass % of azelaic acid and 17.5 mass % of lithium hydroxide, to the total amount of the thickener, and the thickener A (Li-Comp) shown below was used.

(ii) Case in which the Barium Complex Soap (Ba-Comp) was Used as the Thickener

First, the base oil and sebacic acid (thickener component) and carboxylic acid monostearyl amide (thickener component) were mixed in predetermined amounts in a mixing and stirring tank and stirred with heating at about 80 to 200° C., to which barium hydroxide (thickener component) was added to carry out the saponification reaction, followed by cooling to produce a gelatinous substance. Each of the additives such as a PTFE powder was added to the produced gelatinous substance, stirred and subsequently passed through a roll mill or a high-pressure homogenizer to prepare lubricating grease compositions containing each of the components shown below in the mixing amounts (wt %) shown in Table 1 and Table 2. Note that the amount of each component constituting the thickener mixed was 27.5 mass % of sebacic acid, 41.5 mass % of carboxylic acid monostearyl amide and 31 mass % of barium hydroxide, to the total amount of the thickener, and the thickener B (Ba-Comp) shown below was used.

(iii) Case in which the Lithium Soap (Li-OHST) was Used as the Thickener

First, the base oil and 12-hydroxystearic acid (thickener component) and lithium hydroxide (thickener component) were mixed in predetermined amounts in a mixing and stirring tank and stirred with heating at about 80 to 130° C. to carry out the saponification reaction, and the mixture was stirred with heating to a melting temperature and subsequently cooled to produce a gelatinous substance. Each of the additives such as a PTFE powder was added to the produced gelatinous substance, stirred and subsequently passed through a roll mill or a high-pressure homogenizer to prepare lubricating grease compositions containing each of the components shown below in the mixing amounts (wt %) shown in Table 1 and Table 2. Note that the amount of each component constituting the thickener mixed was 88 mass % of 12-hydroxystearic acid and 12 mass % of lithium hydroxide to the total amount of the thickener, and the thickener C (Li-OHST) shown below was used.

Poly-α-olefin A: 40° C. kinetic viscosity 18 $mm^2/s$ (a product of INEOS Oligomers Japan DURASYN 164)

Poly-α-olefin B: 40° C. kinetic viscosity 30 $mm^2/s$ (a product of INEOS Oligomers Japan DURASYN 166)

Poly-α-olefin C: 40° C. kinetic viscosity 46 $mm^2/s$ (a product of INEOS Oligomers Japan DURASYN 168)

Poly-α-olefin D: 40° C. kinetic viscosity 5 $mm^2/s$ (a product of INEOS Oligomers Japan DURASYN 162)

Poly-α-olefin E: 40° C. kinetic viscosity 68 $mm^2/s$ (a product of INEOS Oligomers Japan DURASYN 168)

Poly-α-olefin F: 40° C. kinetic viscosity 400 $mm^2/s$ (a product of INEOS Oligomers Japan DURASYN 174)

Polyolester: 40° C. kinetic viscosity 20 $mm^2/s$ (a product of NOF CORPORATION, Unister H-334R)

Ethylene-α-olefin copolymer A: number average molecular weight 68000, weight average molecular weight 147000 (a product of SHOWA VARNISH CO., LTD. L6Z-25)

Ethylene-α-olefin copolymer B: number average molecular weight 7700, weight average molecular weight 14400 (a product of Mitsui Chemicals, Inc. Lucant HC-2000)

Thickener A: Li-Comp (lithium complex soap)

Thickener B: Ba-Comp (barium complex soap)

Thickener C: Li-OHST (lithium soap)

PTFE resin powder: a product of Mitsui-Dupont Fluorochemicals, TLP-10E-1)

Rust preventive: calcium sulfonate (a product of KING Industries, Inc., NA SUL CA 1089)

Antioxidant: Phenylnaphthylamine (a product of SANYO CHEMICAL INDUSTRIES, Ltd. VANLUBE 81)

Extreme pressure agent: zinc dialkyldithiophoshporate (a $C_{12}$ linear alkyl group) (a product of ADEKA CORPORATION, ADEKA KIKU-LUBE Z-112)

(2) Evaluation Method (2-1) Base Oil Viscosity

The base oil viscosity was measured in accordance with JIS K2283: 2000.

(2-2) Worked Penetration

The worked penetration was each measured in accordance with JIS K2220. 7: 2013.

(2-3) Starting Friction Test

A starting friction test was carried out using a pin-on-disk tester by applying the grease composition onto a disk made of a polyamide (PA) 66 resin material, laying thereon a cylinder (ϕ 10 mm×10 mm) made of a metal (S45C carbon steel) in a transversal position and rotating and sliding at a speed of 5 mm/s while pressing against the disk at a constant load (98 N) in terms of a contact average surface pressure of 46 MPa, thereby measuring a starting friction force occurred between the metallic cylinder and the resin disk at the time of rotating and sliding, whereby the starting friction coefficient (static friction coefficient) was calculated from the friction force. Note that the test temperature was 100° C. and the test time was 5 seconds. In the present disclosure, a numerical value of the starting friction coefficient of 0.100 or less was defined as the passing level, whereas such a value of more than 0.100 was defined as failure.

(2-4) Wear Resistance Test

A wear resistance test was carried out using a pin-on-disk tester by applying the grease composition onto a disk made of a polyamide (PA) 66 resin material, laying thereon a cylinder (ϕ 10 mm×10 mm) made of a metal (S45C carbon steel) in a transversal position and rotating and sliding forwardly-reversely at a speed of 1 m/s for a fixed time while pressing against the disk at a constant load (98 N) in terms of a contact average surface pressure of 46 MPa, thereby measuring the depth of wear (μm) of the resin disk after rotating and sliding to evaluate the wear resistance. Note that the test temperature was 100° C. and the test time was 2 hours (forward rotation: 5 seconds, reverse rotation: 5 seconds). In the present disclosure, a numerical value of the depth of wear of 1.80 μm or less was defined as the passing level, whereas such a value of more than 1.80 μm was defined as failure.

(3) Evaluation Result

The evaluation results on the starting friction coefficient and the depth of wear, when each of the lubricating grease compositions was applied to the resin member (resin disk), are shown in Table 1 and Table 2.

TABLE 1

| | | Example No. | | | | | | | | | |
|---|---|---|---|---|---|---|---|---|---|---|---|
| | | 1 | 2 | 3 | 4 | 5 | 6 | 7 | 8 | 9 | 10 |
| Base oil | Poly-α-olefin A | 81.4 | — | — | 77.6 | — | — | 77.6 | — | 76.9 | 75.9 |
| | Poly-α-olefin B | — | — | 82.4 | — | 83.6 | 76.9 | — | — | — | — |
| | Poly-α-olefin C | — | 79.9 | — | — | — | — | — | 80.4 | — | — |
| | Ethylene-α-olefin copolymer A | 2 | 1.5 | 3 | 1.8 | 1.8 | 1.5 | 2.8 | 2 | 3.5 | 2.5 |
| Thickener | Thickener A | 12 | 12 | 8 | 10 | 10 | 10 | 14 | 9 | 11 | 11 |
| Solid lubricant | PTFE | 4 | 6 | 6 | 10 | 4 | 12 | 5 | 8 | 8 | 10 |
| Other additives | Antioxident | 0.5 | 0.5 | 0.5 | 0.5 | 0.5 | 0.5 | 0.5 | 0.5 | 0.5 | 0.5 |
| | Rust preventive | 0.1 | 0.1 | 0.1 | 0.1 | 0.1 | 0.1 | 0.1 | 0.1 | 0.1 | 0.1 |
| Total (mass %) | | 100 | 100 | 100 | 100 | 100 | 100 | 100 | 100 | 100 | 100 |
| Base oil 40° C. kinetic viscosity ($mm^2/s$) | | 98 | 84 | 160 | 86 | 90 | 80 | 140 | 105 | 200 | 120 |
| Worked penetration | | 270 | 275 | 330 | 295 | 305 | 285 | 265 | 315 | 285 | 280 |
| Static friction coefficient | | 0.087 | 0.083 | 0.096 | 0.081 | 0.090 | 0.088 | 0.095 | 0.092 | 0.097 | 0.084 |
| Depth of wear (μm) | | 1.35 | 1.45 | 1.35 | 1.41 | 1.52 | 1.42 | 1.30 | 1.41 | 1.20 | 1.32 |

TABLE 2

| | | Comparative Example No. | | | | | | | | |
|---|---|---|---|---|---|---|---|---|---|---|
| | | 1 | 2 | 3 | 4 | 5 | 6 | 7 | 8 | 9 |
| Base oil | Poly-α-olefin A | — | — | — | — | — | 43.4 | — | — | — |
| | Poly-α-olefin B | — | — | 81.4 | 58.4 | 79.4 | — | 61.9 | 79.9 | — |
| | Poly-α-olefin C | — | — | — | — | — | — | — | — | 74.4 |
| | Poly-α-olefin D | 79.4 | — | — | — | — | — | — | — | — |
| | Poly-α-olefin E | — | 79.4 | — | — | — | — | — | — | — |
| | Poly-α-olefin F | — | — | — | — | — | 40 | — | — | — |
| | Polyolester | — | — | — | — | — | — | — | — | — |
| | Ethylene-α-olefin copolymer A | 2 | 2 | — | — | 4 | — | 1.5 | 1.5 | — |
| | Ethylene-α-olefin copolymer B | — | — | — | 15 | — | — | — | — | ? |
| Thickener | Thickener A | 12 | 12 | 12 | 10 | 10 | 10 | — | — | 12 |
| | Thickener B | — | — | — | — | — | — | 28 | — | — |
| | Thickener C | — | | — | — | — | — | | 10 | — |
| Solid lubricant | PTFE | 6 | 6 | 6 | 6 | 6 | 6 | 8 | 8 | 6 |
| Other additives | Antioxidant | 0.5 | 0.5 | 0.5 | 0.5 | 0.5 | 0.5 | 0.5 | 0.5 | 0.5 |
| | Rust preventive | 0.1 | 0.1 | 0.1 | 0.1 | 0.1 | 0.1 | 0.1 | 0.1 | 0.1 |
| | Extreme pressure agent | — | | | — | — | — | — | — | — |
| Total | | 100 | 100 | 100 | 100 | 100 | 100 | 100 | 100 | 100 |
| Base oil 40° C. kinetic viscosity ($mm^2/s$) | | 90 | 115 | 30 | 200 | 250 | 100 | 85 | 80 | 100 |
| Worked penetration | | 275 | 270 | 270 | 285 | 280 | 280 | 300 | 285 | 270 |
| Static friction coefficient | | 0.081 | 0.110 | 0.080 | 0.131 | 0.125 | 0.122 | 0.125 | 0083 | 0.116 |
| Depth of wear (μm) | | 2.51 | 1.51 | 3.50 | 1.45 | 1.15 | 1.51 | 1.38 | 2.80 | 1.39 |

| | | Comparative Example No. | | | | | | | |
|---|---|---|---|---|---|---|---|---|---|
| | | 10 | 11 | 12 | 13 | 14 | 15 | 16 | 17 |
| Base oil | Poly-α-olefin A | — | — | — | — | — | — | — | — |
| | Poly-α-olefin B | 78.4 | 83.4 | 74.4 | 83.9 | 71.9 | 80.4 | 65.4 | 78.4 |
| | Poly-α-olefin C | — | — | — | — | — | — | — | — |
| | Poly-α-olefin D | — | — | — | — | — | — | — | — |
| | Poly-α-olefin E | — | — | — | — | — | — | — | — |
| | Poly-α-olefin F | — | — | — | — | — | — | — | — |
| | Polyolester | — | — | — | — | — | — | 13 | — |
| | Ethylene-α-olefin copolymer A | 1 | 2 | 2 | 1.5 | 1.5 | — | — | — |
| | Ethylene-α-olefin copolymer B | — | — | — | — | — | 3 | — | — |
| Thickener | Thickener A | 10 | 6 | 15 | 12 | 12 | 10 | 12 | 12 |
| | Thickener B | — | — | — | — | — | — | — | — |
| | Thickener C | — | — | | — | — | — | — | — |
| Solid lubricant | PTFE | 10 | 8 | 8 | 2 | 14 | 6 | 6 | 6 |
| Other additives | Antioxidant | 0.5 | 0.5 | 0.5 | 0.5 | 0.5 | 0.5 | 0.5 | 0.5 |
| | Rust preventive | 0.1 | 0.1 | 0.1 | 0.1 | 0.1 | 0.1 | 0.1 | 0.1 |
| | Extreme pressure agent | — | — | — | — | — | — | 3 | 3 |
| Total | | 100 | 100 | 100 | 100 | 100 | 100 | 100 | 100 |
| Base oil 40° C. kinetic viscosity ($mm^2/s$) | | 65 | 105 | 105 | 80 | 80 | 80 | 30 | 30 |
| Worked penetration | | 285 | 350 | 350 | 270 | 277 | 280 | 280 | 275 |
| Static friction coefficient | | 0.081 | 0.082 | 0.126 | 0.106 | 0.085 | 0.112 | 0.090 | 0.085 |
| Depth of wear (μm) | | 2.20 | 2.25 | 1.65 | 1.60 | 1.85 | 1.47 | 1.95 | 2.15 |

(Note)
The underlines at the numerical values in Table 2 indicate that the values are outside the suitable range of the present invention and the performance failed to achieve the passing level.

From the evaluation results shown in Table 1, all of Examples 1 to 10 had the numerical values of the starting friction coefficient as small as 0.081 to 0.097 and the numerical values of the depths of wear were also as low as 1.20 to 1.52.

In contrast, from the evaluation results shown in Table 2, all of Comparative Examples 1 to 17 failed to achieve the passing levels of numerical values in either of the starting friction coefficient or the depth of wear.

The present disclosure thus enables the provision of the lubricating grease composition with a decreased starting friction coefficient (static friction coefficient) and improved wear resistance at a contact portion surface of a resin member particularly under a high load state. The lubricating grease composition of the present disclosure is suitable to be used at a sliding portion of various machine parts constituting automobile, machine, electrical and electric equipment, and the like, that use resin materials such as polyamide resins. Specifically, in an automobile, examples include rolling bearings, sliding bearings and gear parts and cam parts of automobile accessories such as electric radiator fan motors, fan couplings, electronically controlled EGR, electronically controlled throttle valves, alternators, and electric power steerings, to which the lubricity is demanded.

The invention claimed is:

1. A lubricating grease composition for a resin member used to be supplied as a lubricant on a surface of at least a sliding portion of a resin member including the sliding portion with another member, wherein the lubricating grease composition for a resin member contains a base oil which consists of a mixed oil of: a poly-α-olefin having a kinetic viscosity at 40° C. of 18 to 30 $mm^2/s$, and an ethylene-α-olefin copolymer having a number average molecular weight of 40,000 to 200,000, a lithium-based complex soap as a thickener, and a polytetrafluoroethylene resin as a solid lubricant having a mixing ratio of 4 to 12 mass % to the entire lubricating grease composition, wherein the base oil, which is the mixed oil of the poly-α-olefin and the ethylene-α-olefin copolymer, has a kinetic viscosity at 40° C. of 80 to 200 $mm^2/s$, and a worked penetration of the lubricating grease composition ranges from 295 to 340.

2. The lubricating grease composition for a resin member according to claim 1, wherein the ethylene-α-olefin copolymer has a mixing ratio ranging from 1.5 to 3.5 mass % to the entire lubricating grease composition.

3. The lubricating grease composition for a resin member according to claim 1, wherein a material of the resin member is a polyamide resin.

4. The lubricating grease composition for a resin member according to claim 1, wherein the other member is a metal member.

* * * * *